US005190089A

United States Patent [19]

Jackson

[11] Patent Number: 5,190,089

[45] Date of Patent: Mar. 2, 1993

[54] PROTECTIVE COLLAPSIBLE BAG ASSEMBLY FOR APPLIANCE ITEMS

[76] Inventor: Gary R. Jackson, 1656 Waterford Rd., Walworth, N.Y. 14568

[21] Appl. No.: 804,045

[22] Filed: Dec. 9, 1991

[51] Int. Cl.[5] ..... B65D 81/18; B65D 65/02

[52] U.S. Cl. ..... 150/165; 206/320; 248/678; 383/121.1

[58] Field of Search ..... 150/154–158, 150/161–166; 206/386, 320; 383/3, 121.1; 68/213, 235 R; 109/29, 1 R, 49, 49.5; 248/678; 229/DIG. 3

[56] References Cited

U.S. PATENT DOCUMENTS

| | | | |
|---|---|---|---|
| D. 240,882 | 8/1976 | Knight | 150/165 X |
| 398,530 | 2/1889 | Moore | 383/3 X |
| 1,744,719 | 1/1930 | Berry et al. | 383/3 |
| 2,300,408 | 11/1942 | Deerwester | 150/154 X |
| 3,038,513 | 6/1962 | Hamlett | 206/320 |
| 3,742,994 | 7/1973 | Pensak | 383/3 |
| 3,788,581 | 1/1974 | Rutzick | 248/678 |
| 3,891,086 | 6/1975 | Isaacs | 206/320 |
| 3,906,129 | 9/1975 | Damois | 150/901 X |
| 3,929,178 | 12/1975 | Hickey | 150/166 X |
| 3,997,054 | 12/1976 | Berghgracht | 206/386 |
| 4,039,098 | 8/1977 | Stilts | 150/901 X |
| 4,206,795 | 6/1980 | Regan | 206/303 X |
| 4,226,327 | 10/1980 | Ballard | 206/320 |
| 4,243,197 | 1/1981 | Wright | 248/678 |
| 4,248,347 | 2/1981 | Trimbee | 206/423 |
| 4,315,535 | 2/1982 | Battle | 150/166 X |
| 4,826,329 | 5/1989 | Bellini | 383/3 |
| 4,844,286 | 7/1989 | Jacobson | 383/121.1 X |
| 4,856,436 | 8/1989 | Campbell | 150/165 X |
| 4,884,686 | 12/1989 | Dupuis | 206/320 |
| 5,080,155 | 1/1992 | Crozier | 206/520 X |

FOREIGN PATENT DOCUMENTS

| | | | |
|---|---|---|---|
| 8769 | 3/1980 | European Pat. Off. | 150/154 |
| 1284732 | 8/1972 | United Kingdom | 383/3 |

*Primary Examiner*—Sue A. Weaver
*Attorney, Agent, or Firm*—Fred L. Denson

[57] ABSTRACT

A collapsible bag assembly is described which provides a barrier for protecting an appliance item against flood water damage. The bag assembly includes a) a water impermeable flexible tube of plastic sheeting which is open at the top and closed at the bottom and b) a platform base attached to the bottom of the tube. The bag assembly is used by positioning the appliance item on the platform base. During passive periods, the bag assembly is in its collapsed position whereby the tube of plastic sheeting is folded and stored along the edge of the platform base in proximity to the lower part of the appliance item. When it is necessary to protect the appliance item against water contact, the bag assembly is deployed to its extended position by lifting the tube of plastic sheeting from its stored position and extending it toward the top of the appliance item where it is secured until such protection is no longer required.

5 Claims, 3 Drawing Sheets

PROTECTIVE COLLAPSIBLE BAG ASSEMBLY FOR APPLIANCE ITEMS

BACKGROUND OF THE INVENTION

1. Field of the Invention

The present matter relates to a collapsible bag assembly which is used to protect an appliance item against water damage. In particular, the invention provides a barrier which encases the appliance item to prevent any unwanted contact with water.

2. Description of the Prior Art

Floods can cause substantial water damage to household appliance items. Most floods occur unexpectedly and provide appliance owners with little or no opportunity to relocate or otherwise protect their appliance items. Thus, when flooding occurs or is imminent, appliance owners rush to remove their appliance items to a dry safe haven before they are damaged by rising flood waters. Those who are unable to respond quickly incur potentially substantial repair or replacement costs. While generalized flooding is usually associated with buildings that are located in low land or flood plain areas, of equal significance is unexpected flooding that occurs in houses located in other areas which is caused by malfunctioning sump pumps, broken water pipes or leaky furnaces or appliances. Certain appliances located in basements are often times placed on blocks to elevate them three or four inches above the basement floor. This, arrangement provides limited protection against flood water damage to the extent that the water level does not rise above the level of the blocks.

The prior art has described the use of a plastic barrier sheet for protecting household plants from the elements as described in U.S. Pat. No. 4,248,347. It has also disclosed a barrier sheet which is used for protecting household surroundings from the mess created by shedding needles when a Christmas tree is removed from a house for disposal. U.S. Pat. No. 4,206,795 describes a collapsible bag which is used for this purpose. The prior art does not suggest a way for protecting appliance items from flood water damage. Thus, there is a need for a quick, simple and inexpensive way to provide such protection during flood emergencies.

It is therefore an object of this invention to provide a barrier sheet which protects appliance items against water damage.

It is a further object of this invention to provide an assembly containing the barrier sheet which permits its quick and convenient manual or automatic deployment during times of emergency.

It is yet another object of this invention to provide an assembly containing a barrier sheet which is easily installed for protective use.

Still another object of this invention is to provide a barrier sheet which protects the surroundings against water damage caused by leaky appliance items.

SUMMARY OF THE INVENTION

In accordance with the present invention, a collapsible bag assembly is provided that includes a barrier which is extendable about an appliance item to protect it against unwanted contact with water and other types of gaseous and liquid fluids that are capable of damaging it. The term "appliance item" as used herein, refers not only to the usual household appliance items such as washers, dryers, refrigerators, freezers, ranges and the like, but also includes hot water heaters, water softeners, humidifiers, dehumidifiers and electronic equipment items. The collapsible bag assembly is comprised of a) a water impermeable, flexible tube of plastic sheeting having an open top, a closed bottom and a side wall disposed between the top and bottom and b) a water impermeable, inflexible base which includes a platform which is attached to the closed tube bottom. Because the base of the bag assembly is positioned under the appliance, the base has load bearing structural capability.

The collapsible bag assembly is normally stored in its collapsed position wherein its side wall is folded and stored at the base of the assembly in proximity to the lower part of the appliance item. When the need arises, the assembly is readily deployed to its extended position wherein the side wall is manually or automatically removed from its stored position and lifted toward the top of the appliance item. In its extended position, the side wall of the bag assembly provides a barrier which protects the appliance item against unwanted water contact.

The collapsible bag assembly described herein provides a barrier of plastic sheeting which protects appliances from water damage. It can be quickly and easily deployed which is a distinct advantage when water damage is imminent such as when flooding occurs or in other emergency situations when time is of the essence. Installation is also simple since the bag assembly need only be placed under the appliance item to render it ready for use when the need arises. The collapsible bag assembly can be used to protect machines and instruments as well as appliances against unwanted contact with other types of fluids other than water including various liquids and gases, water vapor and air. It is also usable as a dust cover to protect appliance items from airborne dust particles during times of storage. In addition to its usefulness for protecting appliance items against water damage, it can also be used to protect appliance items, surroundings from damage caused by leaks in appliance items such as washers, hot water heaters, water softeners and dehumidifiers.

The invention and its objects and advantages will become more apparent by referring to the accompanying drawings and to the ensuing detailed description of the preferred embodiment.

DETAILED DESCRIPTION OF THE PREFERRED EMBODIMENTS

Figure 1B:
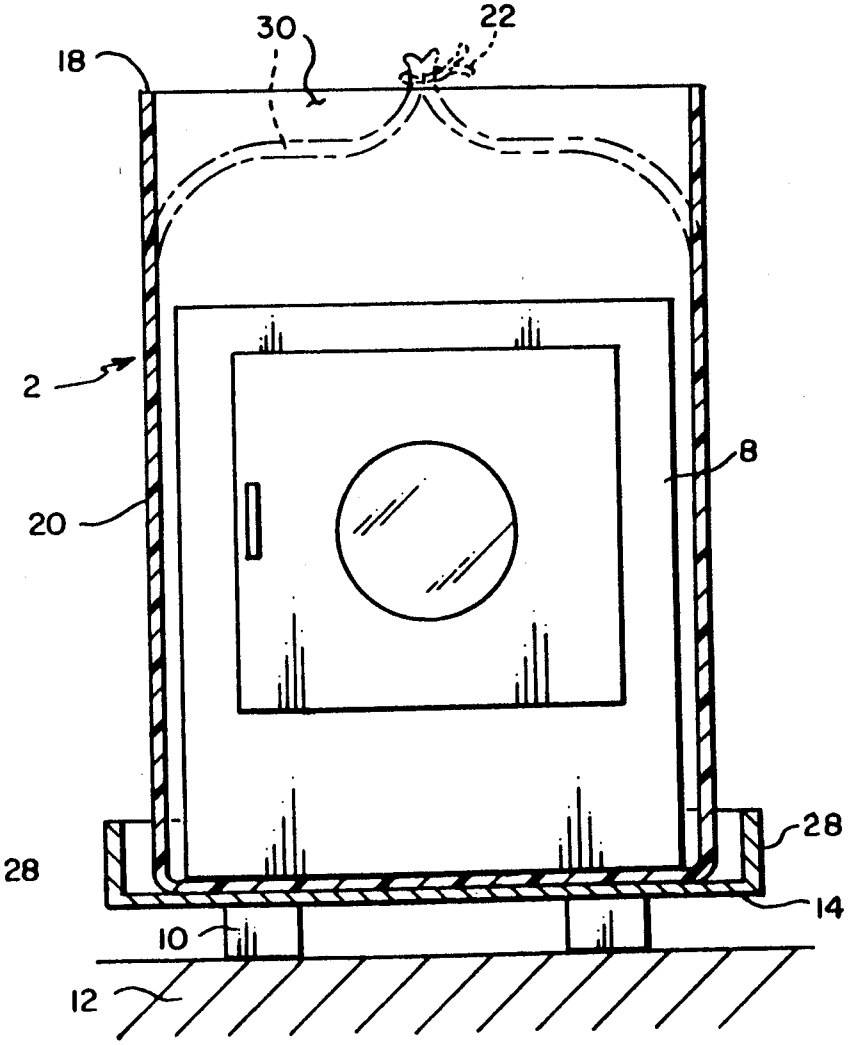
FIGS. 1*a* and 1*b* are front elevations of the collapsible bag assembly of this invention showing a barrier side wall in a stored and manually extended position.
Figure 1A:
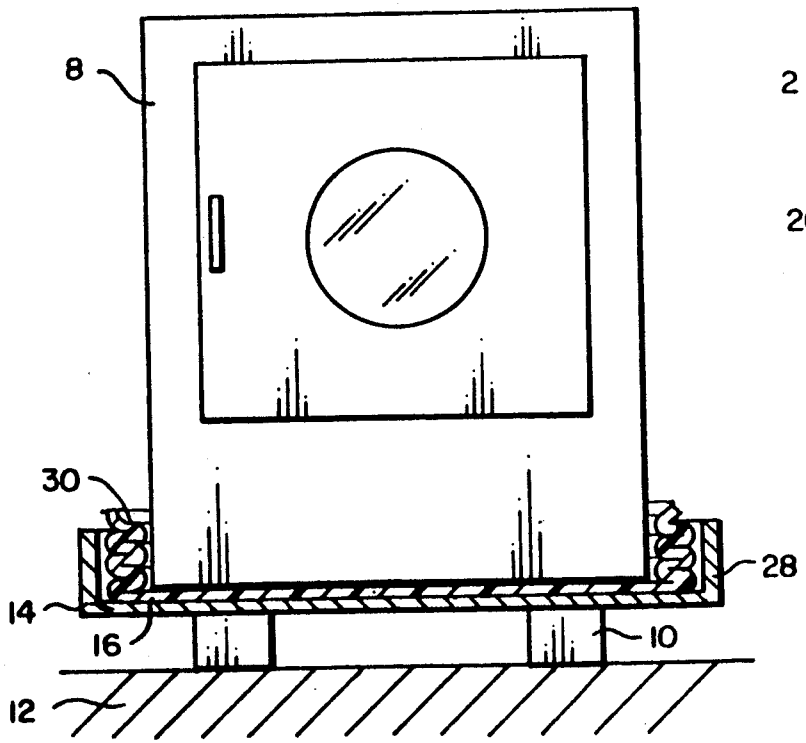

As shown in FIGS. 1*a* and 1*b*, appliance item 8 is supported by blocks 10 which are positioned on surface 12 such as a basement floor. Appliance item 8 can also be positioned directly on surface 12 and blocks 10 omitted (not shown) depending on local building codes and the possibility of the presence of water on the surface. Collapsible bag assembly 30 of this invention is extendable about appliance item 8 to either partially or fully encase it when the need arises to completely protect it against water damage. Collapsible bag assembly 30 includes a tube of plastic sheeting 2 having an open top 18, a closed bottom 16 and side wall 20 disposed between tube top 18 and tube bottom 16. Plastic sheeting 2 is preferably fabricated from any of the standard materials that are customarily used for plastic bags designed for household purposes such as vinyl, polyethylene, polypropylene and the like. Other types of materials can be used as well so long as they are flexible and not penetrable by water.

Platform 14 is attache dot tube bottom 16 and comprises the base of bag assembly 30. It is constructed of any inflexible, water impermeable material which is structurally capable of supporting the weight of appliance item 8. Any rigid, reinforced plastic is suitable as well as other types of water impermeable, load bearing materials. The shape of platform 14 is conformable to the cross sectional shape of tube 2. It optionally includes lip 28 which forms a rim around the edge of the platform. Platform 14 and tube bottom 16 are preferably attached with a water resistant bonding material in a manner which results in a water tight seal.

In the collapsed position, side wall 20 of bag assembly 30 is folded and stored in proximity to the lower part of appliance item 8 along the perimeter of platform 14 as shown in FIG. 1*a*. When platform 14 includes optional lip 28, side wall 20 is stored in the trough formed by the space between lip 28 and the lower part of appliance item 8. When it is necessary to protect appliance item 8 from water damage, collapsible bag assembly 30 is deployed to its extended position as shown in FIG. 1*b*. This is accomplished by manually lifting tube top 18 to the top of the appliance. Bag assembly 30 is secured in its fully extended position with twist tie 22 or by other suitable means. When in this position, tube 2 with platform 14 of bag assembly 30, provide a water impermeable barrier which prevents unwanted water contact with the appliance item and protects it against water damage. When there is no longer a need for this protection, bag assembly 30 is returned to the stored position of FIG. 1*a*.

Figure 2B:
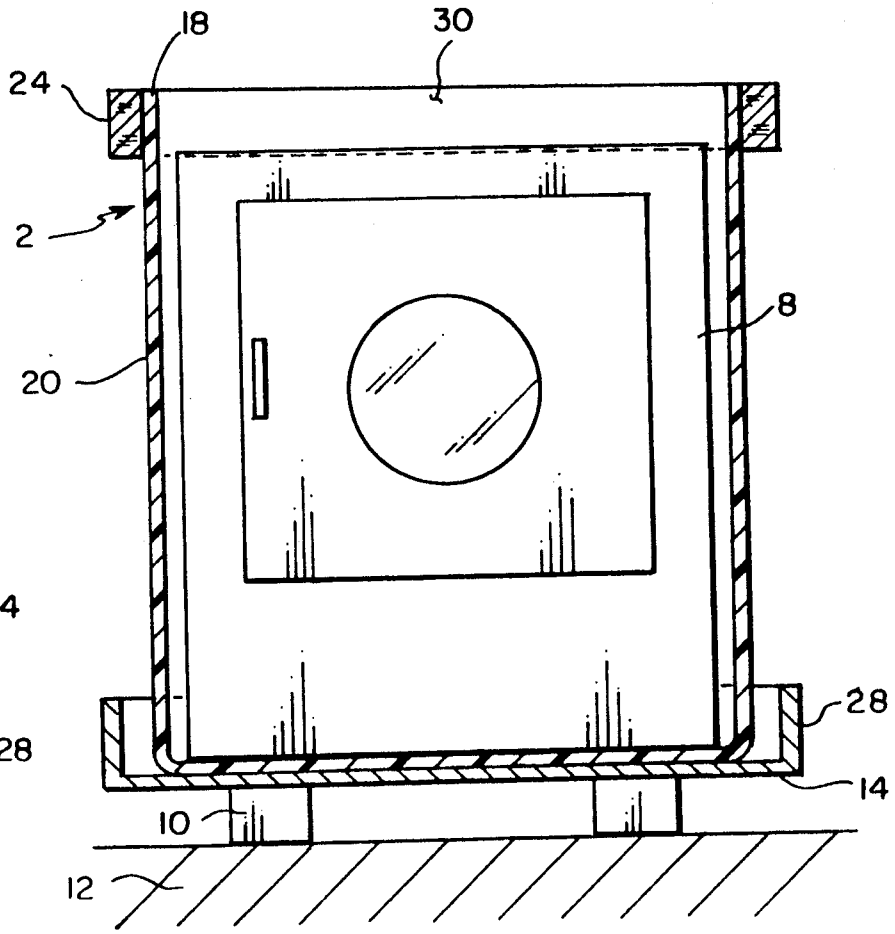
FIGS. 2*a* and 2*b* are front elevations of the collapsible bag assembly of this invention showing a flotation means attached to a barrier side wall and showing the barrier side wall in a stored and automatically extended positions.
Figure 2A:
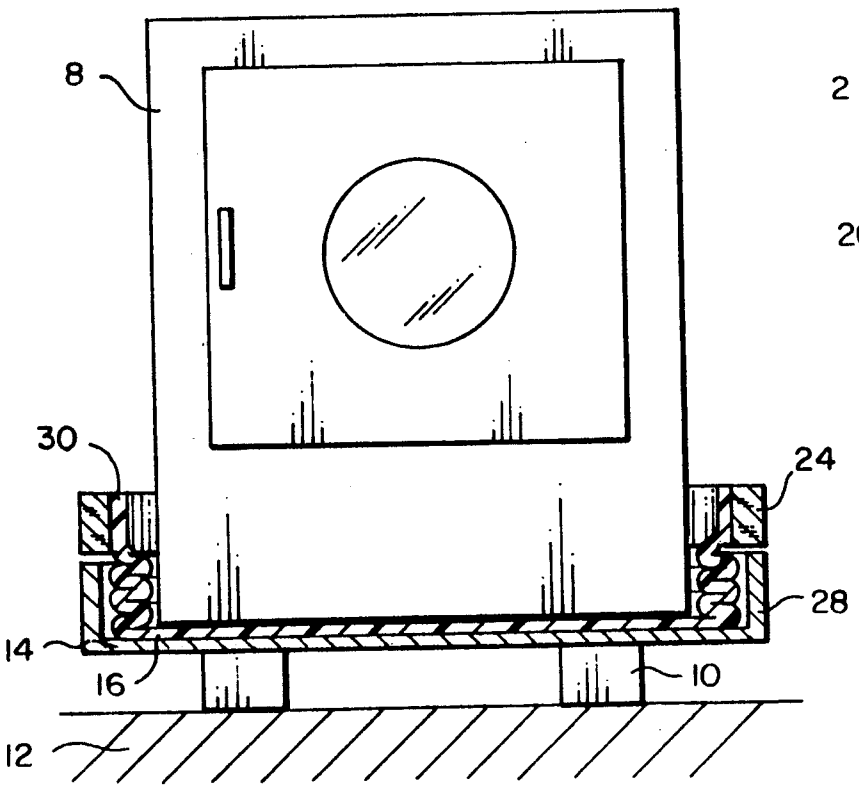

In the embodiment of the invention shown in FIGS. 2*a* and 2*b*, flotation means 24 is attached to tube top 18 of bag assembly 30. Flotation means 24 is comprised of any type of flotation device or buoyant material. Particularly suitable buoyant materials include low density synthetic polymers as well as natural materials including cork, wood, styrofoam or any other material having a density less than water. Flotation means 24 is attached to tube top 18 by any suitable method and, when a buoyant material is used, may be configured in a manner such that it forms a collar which is positioned around the bottom of the appliance item. When rising water reaches flotation means 24, the buoyant force of the water causes the flotation means to rise with the rising water. Since tube top 18 of bag assembly 30 is attached to flotation means 24, it rises simultaneously with the flotation means thereby causing extension of side wall 20. This eliminates the necessity for manually extending bag assembly 30 in times of need. When the water level subsides, flotation means 24 is lowered and bag assembly 30 is eventually returned to its collapsed position. While bag assembly 30 may not become fully extended, a sufficient part of side wall 20 is extended to provide an effective protective barrier against water intrusion.

Figure 3:
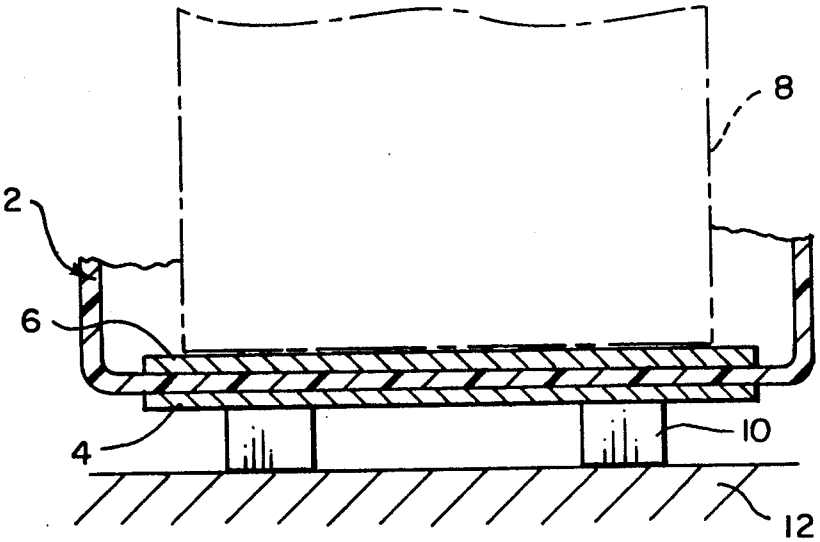
FIG. 3 is a front elevation of the base of the collapsible bag assembly of this invention showing two plates at the base of the assembly.

In the embodiment of the invention depicted in FIG. 3, the base of the bag assembly includes a platform which is comprised of upper base plate 6 and lower base plate 4 with tube bottom being sandwiched between and attached to the two base plates. Upper and lower base plates are fabricated from any of the materials previously described as being suitable for platform 14. This configuration for the base of the bag assembly provides extra protection against water intrusion since both sides of tube bottom 16 are sealed to upper and lower base plates 6 and 4. Thus, if the seal between tube bottom 16 and lower base plate 4 should lose its integrity and leak, the barrier provided by tube bottom 16 and upper base 6 which is sealed to tube bottom 16 will prevent water from coming in contact with appliance item 8. Moreover, the configuration of the two plates provides greater load bearing capability to the base of the bag assembly thereby making it useful with larger and heavier appliances.

Figure 4:
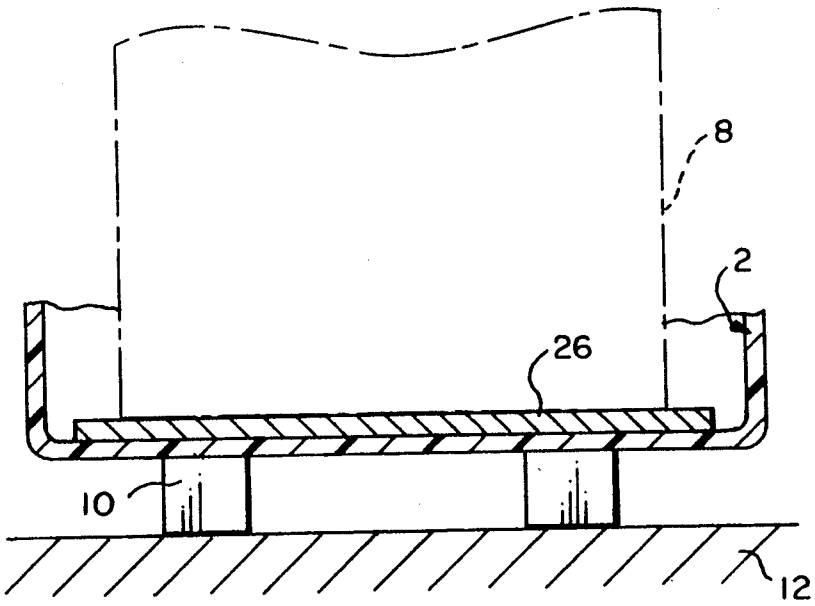
FIG. 4 is a front elevation of the base of the collapsible bag assembly of this invention showing a platform positioned inside of the bag assembly.

When platform 14 consists of a unitary structure which is attached to tube bottom 16, it is positioned outside of tube bottom 16 so that tube bottom 16 is disposed between platform 14 and the bottom of appliance item 8 as shown in FIGS. 1*a*, 1*b*, 2*a* and 2*b*. In another embodiment as shown in FIG. 4, platform 26 is positioned inside of tube bottom 16 so that platform 26 is disposed between tube bottom 16 and the bottom of appliance item 8. This arrangement is advantageous for situations where it is desirable to prevent water from coming into contact with platform 26.

The invention has been described with reference to a preferred embodiment thereof. However, variations and modifications can be effected within the spirit and scope of the invention. For example, a tube of plastic sheeting having an open top and an open bottom can be used instead of a tube having an open top and a closed bottom as part of the bag assembly. When an open bottom tube is employed, the base of the bag assembly is formed by sealing the edge of the open bottom to the platform with a water proof sealant.

I claim:

1. A collapsible bag assembly for extension about an appliance item to protect it from water damage, said collapsible bag assembly comprising:

(a) a water impermeable, flexible tube of plastic sheeting having disposed at opposite ends thereof an open tube top and a closed tube bottom, and having a side wall disposed between the tube top and the tube bottom; and (b) a water impermeable, inflexible base comprising a platform attached to the closed tube bottom, said platform being structurally capable of supporting the appliance.

2. The collapsible bag assembly of claim 1 wherein the platform which is attached to the closed tube bottom comprises an upper base plate and a lower base plate with the closed tube bottom being disposed between the upper and lower base plates.

3. The collapsible bag assembly of claim 1 having flotation means attached to the open tube top.

4. The collapsible bag assembly of claim 3 wherein the flotation means is comprised of a buoyant material.

5. The collapsible bag assembly of claim 1 wherein the plastic sheeting consists of a vinyl material.

* * * * *